US007685749B2

(12) United States Patent
Loeffelholz et al.

(10) Patent No.: US 7,685,749 B2
(45) Date of Patent: Mar. 30, 2010

(54) SOIL STRIPPING DEVICE

(75) Inventors: Stefan Franz Loeffelholz, Leinefelde (DE); Josef Maierhofer, Zeilarn (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 12/007,807

(22) Filed: Jan. 15, 2008

(65) Prior Publication Data

US 2008/0179069 A1 Jul. 31, 2008

(30) Foreign Application Priority Data

Jan. 26, 2007 (EP) ..... 07001768

(51) Int. Cl.
*E02F 3/60* (2006.01)

(52) U.S. Cl. ..... 37/398; 37/379; 37/401; 37/461; 37/184; 37/186

(58) Field of Classification Search ..... 37/398, 37/379, 461, 184, 187, 182, 468, 401, 186; 166/355

See application file for complete search history.

(56) References Cited

U.S. PATENT DOCUMENTS 2,486,479 A * 11/1949 Kennedy ..... 414/726
3,695,473 A * 10/1972 Martin ..... 414/625
3,721,293 A * 3/1973 Ahlstone et al. ..... 166/355
3,779,395 A * 12/1973 Dykeman ..... 212/81
4,333,676 A * 6/1982 Thumm ..... 294/88
4,616,708 A * 10/1986 da Mota ..... 166/355
6,076,290 A * 6/2000 Seitle et al. ..... 37/398
6,470,969 B1 * 10/2002 Sørhaug et al. ..... 166/355
6,834,723 B2 * 12/2004 Jordan ..... 166/355
7,114,271 B2 * 10/2006 Chagnot et al. ..... 37/352

FOREIGN PATENT DOCUMENTS

| | | |
|---|---|---|
| DE | 2448881 | 4/1976 |
| DE | 2750371 | 5/1978 |
| EP | 0016736 | 10/1980 |
| EP | 0533559 | 3/1993 |
| EP | 0649716 | 4/1995 |
| EP | 0872596 | 10/1998 |
| GB | 1576151 | 10/1980 |
| JP | 55152228 | 11/1980 |
| JP | 07 003835 | 1/1995 |

* cited by examiner

*Primary Examiner*—Thomas A Beach
*Assistant Examiner*—Matthew R Buck
(74) *Attorney, Agent, or Firm*—Jacobson Holman PLLC

(57) ABSTRACT

The invention relates to a soil stripping device, in particular a trench wall grab, comprising a base body, which can be connected to a carrier implement, a work unit, on which soil working tools are arranged and which is supported on the base body in a rotatable manner by means of a bearing device, and a rotary device for rotating the work unit with respect to the base body. The rotary device has at least one linear drive and a rope or chain transmission, through which a linear movement generated by the linear drive can be translated into a rotating movement.

9 Claims, 5 Drawing Sheets

SOIL STRIPPING DEVICE

The invention relates to a soil stripping device, in particular a trench wall grab, comprising a base body which can be connected to a carrier implement, a work unit on which soil working tools are arranged and which is supported on the base body in a rotatable manner by means of a bearing device, and a rotary device for rotating the work unit with respect to the base body about an axis of rotation.

Devices of such kind serve to excavate recesses or ditches in the soil which are predominantly required for the production of foundation or sealing elements in the soil. When using grabs with grab scoops, in particular when relatively deep trench walls are produced, there is the risk that asymmetries resulting in particular from a non-symmetrical distribution of the grab teeth on the grab scoops may lead to an undesired deviation from the vertical. In order to compensate this it is known to rotate the grab scoop by 180° at regular intervals, especially after each stroke. In doing so, the deviations stemming from an asymmetrical teeth arrangement can be neutralized.

A generic soil stripping device can be taken for instance from JP 55-152228 A. In this known device the work unit with the grab scoops is supported by means of a rotary device on a telescopic device. The rotation takes place by a rotary motor having a drive pinion and an external gear wheel that is connected to the work unit. Since the rotary device is attached to the lower end of the telescopic device, the rotary device is moved together with the grab scoops into the ditch or trench. Especially in the case of trenches filled with support suspension this may lead to interference with the rotary motor and the sensitive transmission.

To avoid this problem it is known for example from EP 0 533 559 B1 that the rotary device is arranged at the upper end of the telescopic guide on the transition to the boom of the carrier implement. However, in this arrangement the rotary device also has to rotate the entire telescopic guide, which results not only in a higher expenditure of force but also in a correspondingly complicated design of the rotary motor and the rotary bearings. In addition, an exchange of the telescopic unit is rendered more difficult, which is necessary e.g. when greater stripping depths are desired.

In EP 0 872 596 B1 a rotary device is suggested, in which the rotary motor is mounted in a fixed manner on the upper segment of the telescopic guide. On the work unit a drive shaft is provided which only engages with the rotary motor through a coupling device if the telescopic guide is fully retracted and the work unit with the grab scoops is fully withdrawn from the soil. For rotational safety of the work unit uncoupled from the rotary motor a complicated brake device is needed.

The invention is based on the object to provide a soil stripping device, wherein a work unit that has a simple and robust construction can be rotated in a particularly reliable manner.

The object is solved in accordance with the invention by a soil stripping device having the features of claim 1. Preferred embodiments are stated in the dependent claims.

The soil stripping device according to the invention is characterized in that the rotary device has at least one linear drive and a rope or chain transmission, through which a linear movement generated by the linear drive can be translated into a rotating movement.

A fundamental idea of the invention resides in the fact that the rotating movement is not generated by a rotary motor that has a relatively complicated reduction gear unit but instead by a simple, robust linear drive. For the translation of the linear drive movement into a rotating movement a rope or chain transmission of equally simple design is provided. Transmissions of such kind make use of a flexible element, such as a rope or a chain. Within the meaning of the invention a rope or chain transmission is not to be understood in the narrow sense as making use of a rope or a chain as a flexible element but rather bands, belts and other flexible elements are comprised, too. By simply winding these elements around a wheel a linear movement can be translated into a rotation. Even in a rough environment and where a lot of dirt is involved such flexible, deflectable elements can be employed reliably whilst requiring little maintenance. In addition, relatively high torques can be supplied for a limited number of rotations, which is fully sufficient for the application in accordance with the invention.

Basically, various drives such as a rack-and-pinion drive or a ball spindle drive are conceivable as a linear drive. However, according to the invention it is especially preferred that the linear drive has a setting cylinder, in particular a hydraulic cylinder, on the piston rod of which a flexible element of the transmission is attached. Setting cylinders, especially hydraulic cylinders, are very compact and can supply very high forces. Moreover, soil stripping devices are usually already provided with a hydraulic system that comprises a great number of hydraulic cylinders. Especially in the case of trench wall grabs, hydraulic setting cylinders are employed to actuate the grab scoops for example. Hence, the linear drive for the rotary device according to the invention can be integrated into an existing system without a great deal of work being required.

The invention can be realized with one or several setting cylinders. In particular, the use of two single-acting setting cylinders is conceivable that are arranged and can be operated in opposite directions with respect to each other. According to the invention an especially compact arrangement is achieved in that the setting cylinder is a double-acting setting cylinder, from the cylinder housing of which a piston rod protrudes on both sides, and in that a flexible element of the transmission is attached to both ends of the piston rod. As a result, a defined rotation and back-rotation can be attained. In addition, a reliable tensioning of the flexible element or elements is ensured because a tensile force is generated constantly during the extending and retracting movement.

Furthermore, according to the invention it is of advantage for the rope or chain transmission to have a setting wheel, to which at least one flexible element is linked and around which this is wound at least partially. The linking of the flexible element to the setting wheel is located in a radially spaced manner to the axis of rotation of the said wheel. This spacing constitutes the lever arm, with which the linear tensile force of the flexible element is translated into a torque for rotating the work unit. The fixing of the rope on the setting wheel can be achieved in a known manner through a form-locking and/or force-locking kind of connection, such as e.g. through screws, clamps or in another way. By preference, a retaining bolt is provided for this purpose on the setting wheel, into which an eyelet located at the end of the flexible element can be hooked. According to the length of the linear movement and depending on the effective circumference of the setting wheel a rotation is brought about.

A particularly robust and effective direct drive is achieved according to the invention in that the setting wheel is arranged in the portion of the bearing device and coaxially to the axis of rotation. The setting wheel is arranged in a fixed manner on the base body, which is itself arranged in a rotationally fixed manner with respect to the carrier implement. Therefore, a tensile force applied to the flexible element brings about a direct rotation of the work unit relative to the setting wheel and the base body. Transmissions employed for compensating an offset of axis are not necessary here.

In the arrangement of the setting wheel on the base body in accordance with the invention the linear drive is located on the work unit. On the frame of the work unit there is a sufficient amount of free space. Alternatively, in the reverse case the setting wheel can be arranged in a rotationally fixed manner on the work unit, while the linear drive is provided on the base body so as to bring about a desired relative rotation between work unit and base body. A lifting device, i.e. for instance a telescopic rod or a Kelly rod, can be arranged above or below the bearing device. The transmission of the tensile force to the setting wheel can also take place exclusively by means of frictional force through a partial or repeated winding of the rope.

The axis of rotation of the rotary device substantially extends parallel to the sinking direction which usually is the vertical. For specific application purposes certain deviations by a few degrees of angle are possible.

For a particularly reliable rotation provision is made in accordance with the invention in that two flexible elements are linked to the setting wheel, through which an opposed rotating movement can be effected respectively. The arrangement and winding of the flexible elements on the setting wheel is implemented in opposite directions so that when a tensile force is applied to the elements, they each generate a rotational movement in an opposite direction. In this way a reliable rotation and back-rotation can be ensured.

As already explained, the flexible element can be a chain, a band, a belt etc. as long as it permits a linear movement, deflection and winding at the same time. However, a particularly cost-saving, simple and reliable embodiment of the invention can be seen in the fact that the flexible element is a steel rope. Steel ropes are commonly used for trench wall devices, for example as lifting or supporting ropes. Even when used directly in a trench with support suspension steel ropes are extremely robust and hardly require any maintenance.

An especially reliable arrangement is achieved in accordance with the invention in that on the bearing device connections for hydraulic fluid are provided. To pass the hydraulic fluid through the rotary device from the carrier implement to the work unit a known rotary feedthrough can be provided. Since only one rotation of the work unit by 180° together with a subsequent back-rotation is normally provided, a flexible bridging of the hydraulic lines from the base body to the work unit can also be effected by flexible hose lines.

Furthermore, according to the invention a carrier implement comprising a boom is provided, to which a rotationally fixed lifting device is attached, at the lower end of which the work unit is arranged. Usually, the carrier implement is a track-laying vehicle having an upper carriage, to which a rope-actuated mast or boom is linked. The lifting device can be a single, vertically displaceable bar or slide, a telescopic cylinder or a rope-actuated Kelly rod. On account of its compactness and robustness the rotary device according to the invention can be arranged in almost any chosen place, as for example between the boom and the lifting device or preferably between the lifting device and the work unit.

The soil stripping device is preferably a trench wall grab, but is not limited thereto. In principle, use can also be made in other types of trench wall devices, for example in trench wall cutters having rotatably arranged cutting wheels, especially if an irregular teeth arrangement is provided for the cutting wheels.

In the following the invention will be described further by way of preferred embodiments shown schematically in the drawings, wherein.

Figure 1:
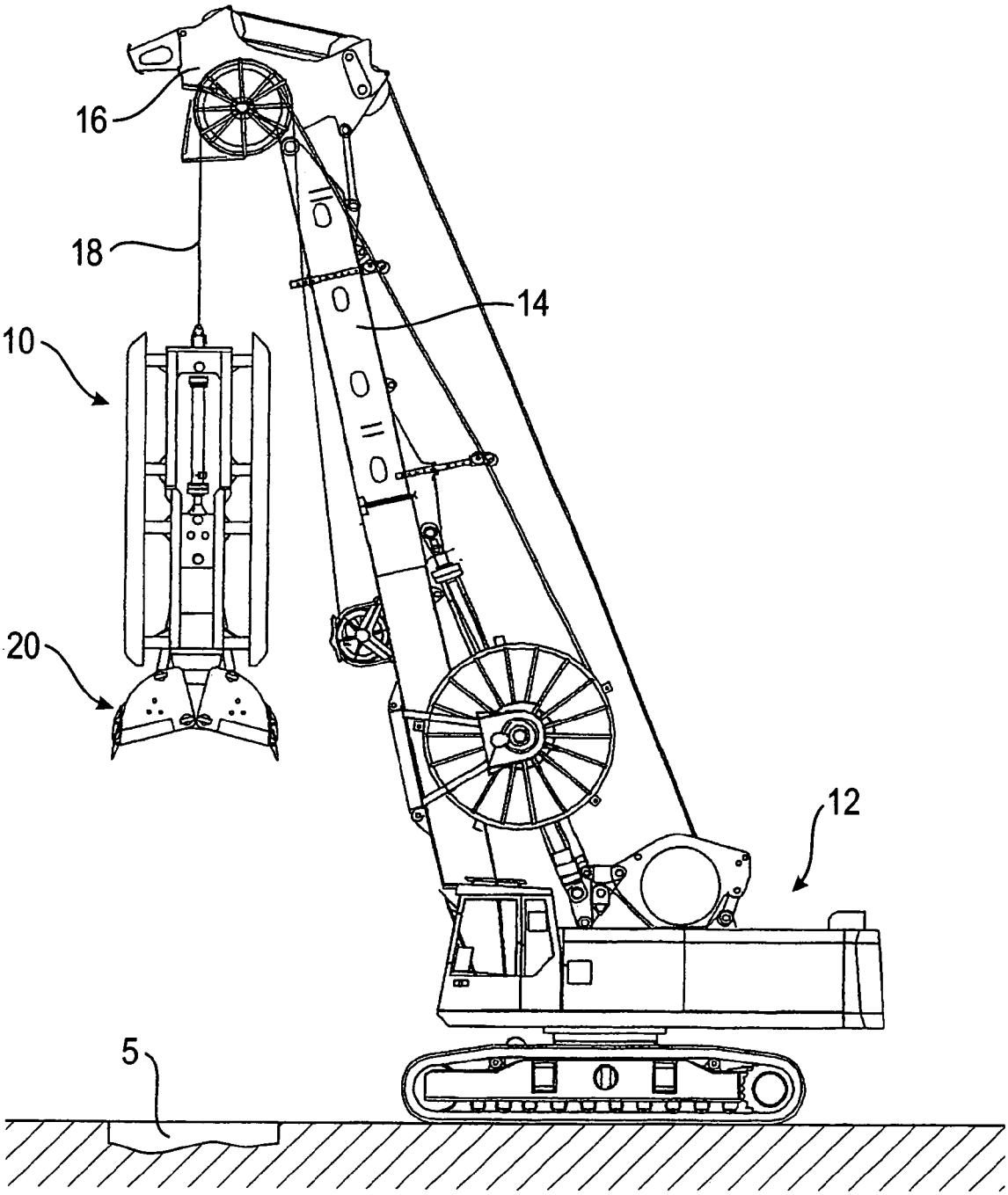
FIG. 1 shows a side view of a soil stripping device with a carrier implement according to the invention.

The basic construction of a soil stripping device 10 according to the invention for producing a trench 5 in the soil is shown schematically in FIG. 1. On a carrier implement 12 having an approximately vertically directed mast 14 with a mast head 16 a work unit 20 for excavating a trench 5 is arranged in a vertically displaceable manner by means of a lifting device 18 consisting of several support ropes.

Figure 2:
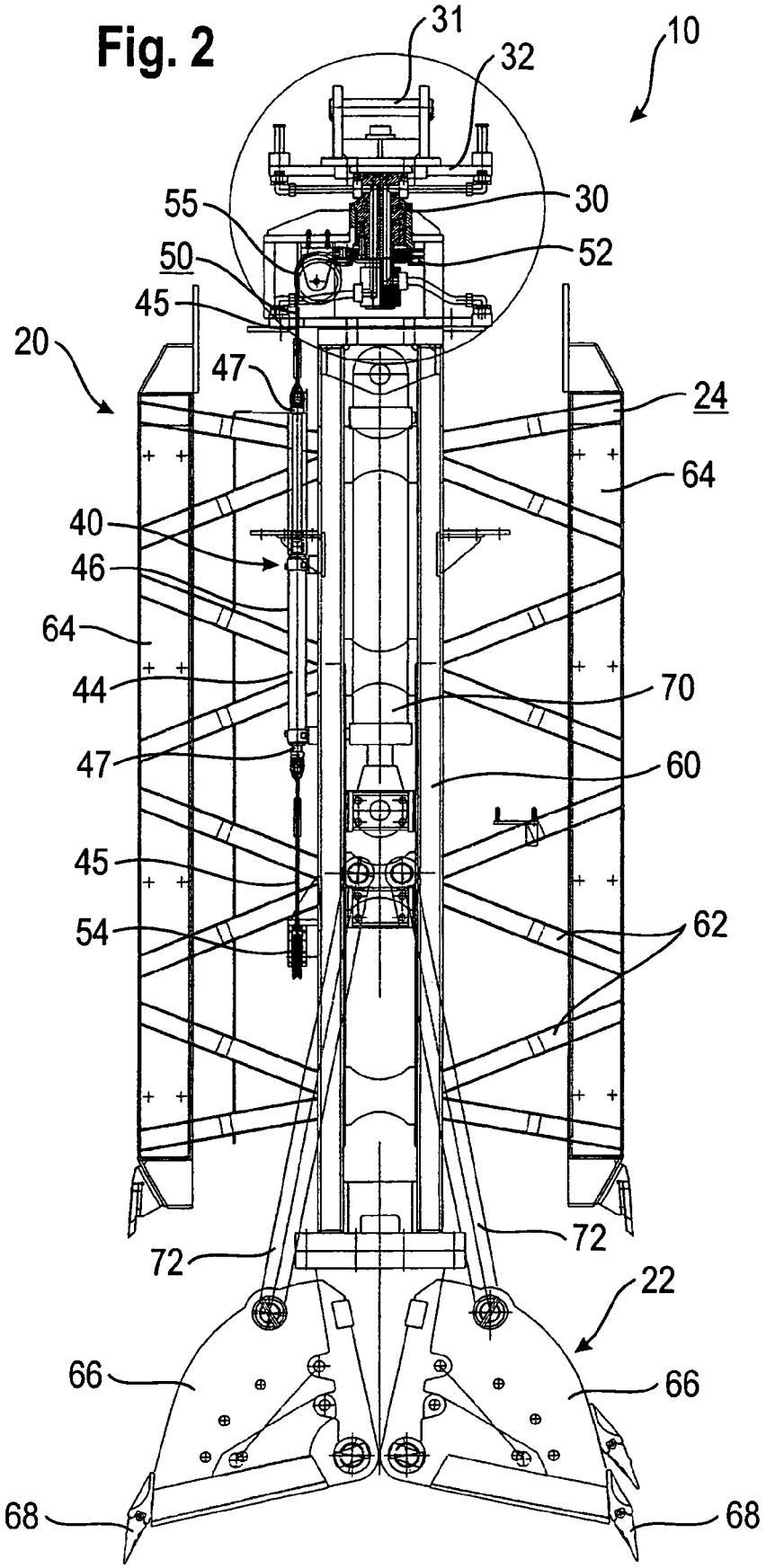
FIG. 2 shows a further embodiment of a soil stripping device with grab scoops according to the invention.

According to FIG. 2 a soil stripping device 10 according to the invention is shown which is designed as a trench wall grab. The trench wall grab comprises a frame 24 with a centrally disposed longitudinal girder 60, on which lateral guide plates 64 are arranged in a known manner through crossbars 62. At the lower end of the longitudinal girder 60 two grab scoops 66 with teeth 68 are pivoted as soil stripping tools 22. Through a hydraulic actuating cylinder 70 arranged centrally on the longitudinal girder 60 the grab scoops 68 can be opened and closed by means of actuating rods 72 so as to strip and receive soil material in a known manner. At the upper end of the longitudinal girder 60 a bearing device 30 is arranged, by which the work unit 20 is supported in a pivotable manner by 180° on the base body 32. The base body 32 has a holding device 31, by means of which the trench wall grab can be releasably attached to a lifting device for substantially vertical displacement.

To pivot the work unit 20 with respect to the base body 32 a rotary device 40 is designed that has a linear drive 44 designed as a setting cylinder and a rope transmission 50. The linear drive 44 has a cylinder housing 46, from both ends of which a piston rod 47 extends, respectively. The piston rods 47 are arranged along a longitudinal axis of the work unit 20 and can be displaced for actuation of a rope as a flexible element 45.

The rope transmission 50 comprises a lower deflection roller 54, two upper deflection rollers 55 and a setting wheel 52. While the setting wheel 52 is attached in a rotationally fixed manner to the base body 32, the lower deflection roller 54 and the upper deflection rollers 55 are supported in a rotatable manner on the frame 24 of the work unit 20. In the present embodiment the flexible element 45 is formed by two separate ropes, which are each fixed with one end to a piston rod 47 and with the other end to the setting wheel 52 and partially wind around this. Through this arrangement a closed operating circle is formed so that when the piston rods 47 are operated in opposed directions the flexible element 45 is constantly kept under tension.

Figure 3:
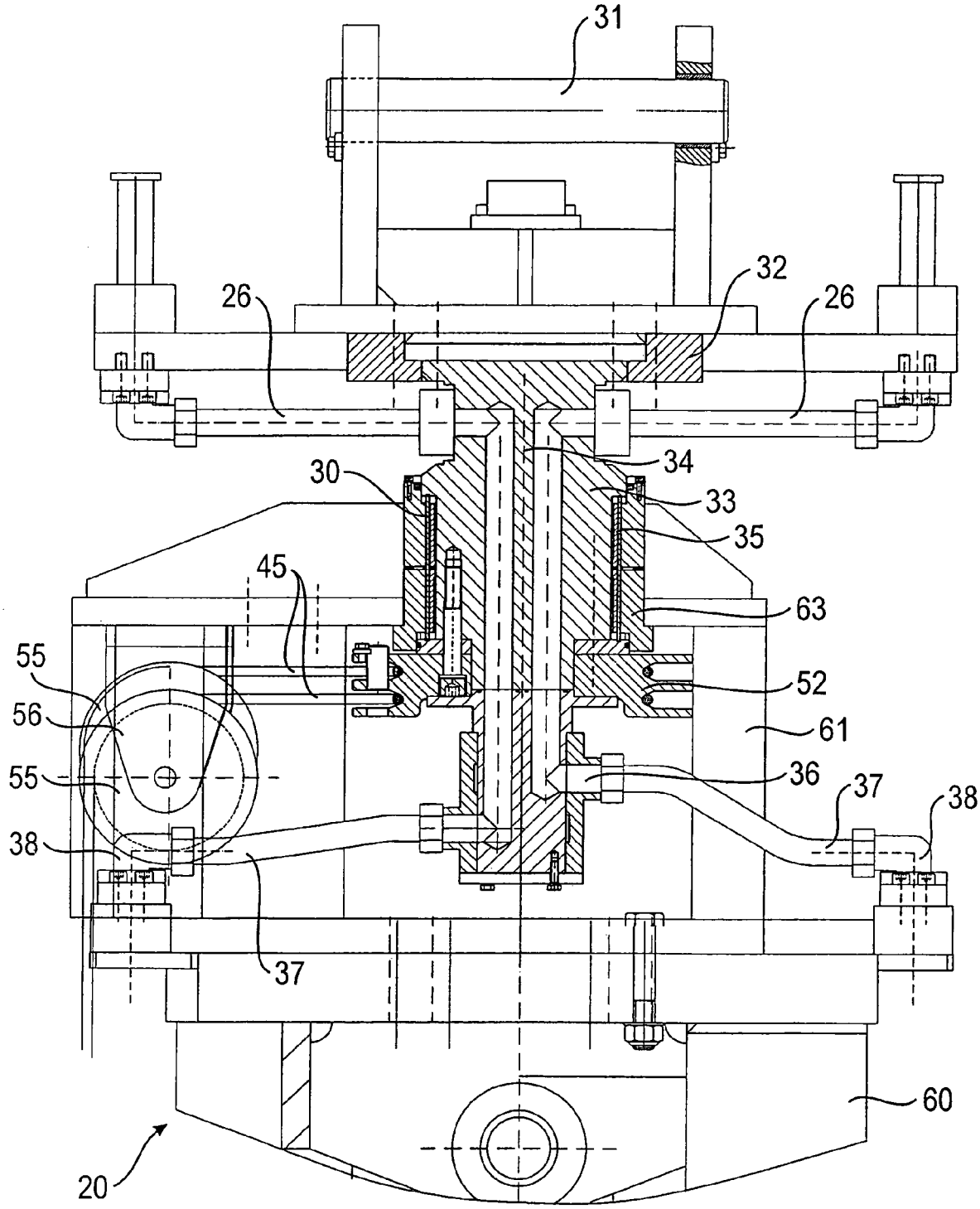
FIG. 3 shows a detailed view concerning FIG. 2 with the rotary device.

In the following the support and rotation of the work unit 20 will be described with reference to FIG. 3. At the top of the base body 32 the bolt-shaped holding device 31 and at the bottom a bearing journal 33 are arranged in a fixed manner. For rotatable support a bearing bush 35, in particular a friction bearing, is arranged on the outside of the bearing journal 33 and retained on its outside by a receiving sleeve 63. The receiving sleeve 63 is fixedly connected through a holder 61 with the longitudinal girder 60. Hence, through the bearing bush 35 the receiving sleeve 63 and the entire work unit 20 is supported in a rotating manner with respect to the base body 32.

The holder 61 has a free space, into which the free end of the bearing journal 33 protrudes. On the bearing journal 33 the setting wheel 52 is fixed, which has two grooves on its outer circumference in order to receive a rope as flexible element 45. By means of the two upper deflection rollers 55, which are each supported in a rotating manner through a bearing block 56 on the holder 61 of the work unit 20, the flexible element 45 that extends vertically and parallel to the axis of rotation 34 is deflected in a horizontal direction towards the setting wheel 52 so that the ropes are led into the respective grooves of the setting wheel 52. The setting wheel 52 is arranged coaxially to the axis of rotation 34, which coincides with a longitudinal axis of the work unit 20.

At the lower end of the bearing journal 33 a connecting piece with connections 36 for hydraulic fluid is arranged. Through hydraulic lines 26 located on the base body 32, which lead to a hydraulic supply on the side of the carrier implement, hydraulic fluid can be passed through the interior of the bearing journal 33, via the connections 36 and by means of flexible hose lines 37 to connecting sockets 38 attached in a fixed manner on the rotatable work unit 20. The hydraulic supply serves in particular for the supply of the setting cylinder for the grab scoops as well as for the linear drive of the rotary device.

Figure 4:
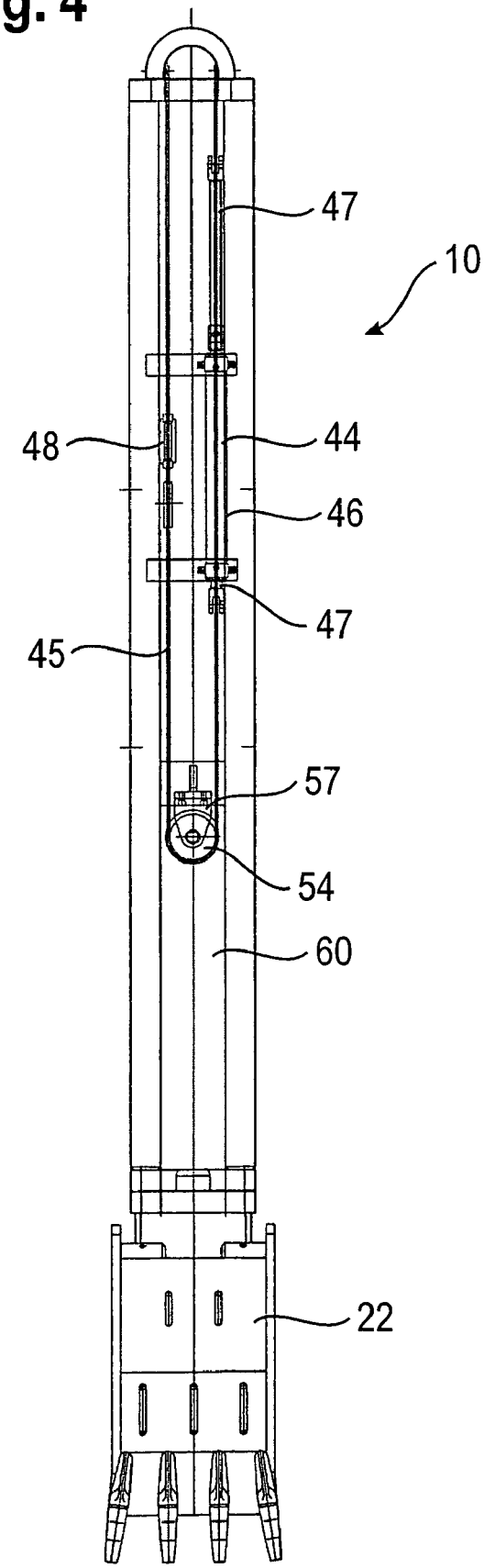
FIG. 4 shows a side view of the soil stripping device of FIG. 2.

According to the side view of FIG. 4 the lower deflection roller 54 is supported in a rotating manner through a lower bearing block 57 on the longitudinal girder 60 of the stripping device 10. The linear drive 44 arranged parallel to the vertical and to the longitudinal axis of the device includes a cylinder housing 46 that is fixed to the longitudinal girder 60.

According to FIG. 4 the lower piston rod 47 is retracted, whereas the upper piston rod 47 is extended in the opposite direction so that the flexible element 45 is constantly kept under tension. For tension adjustment a tensioning device 48 is arranged along a free portion of the flexible element 45.

Figure 5:
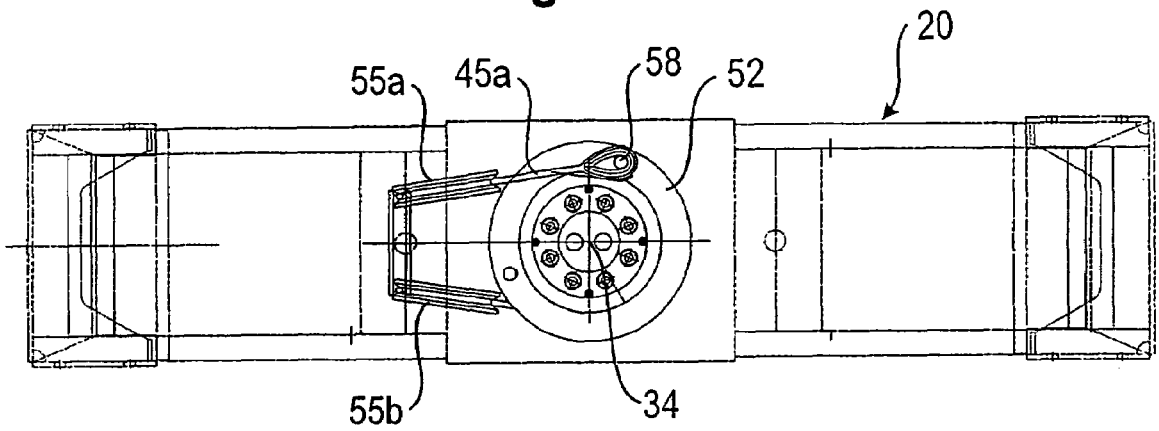
FIG. 5 shows a view of the soil stripping device of FIG. 2 from above.
Figure 6:
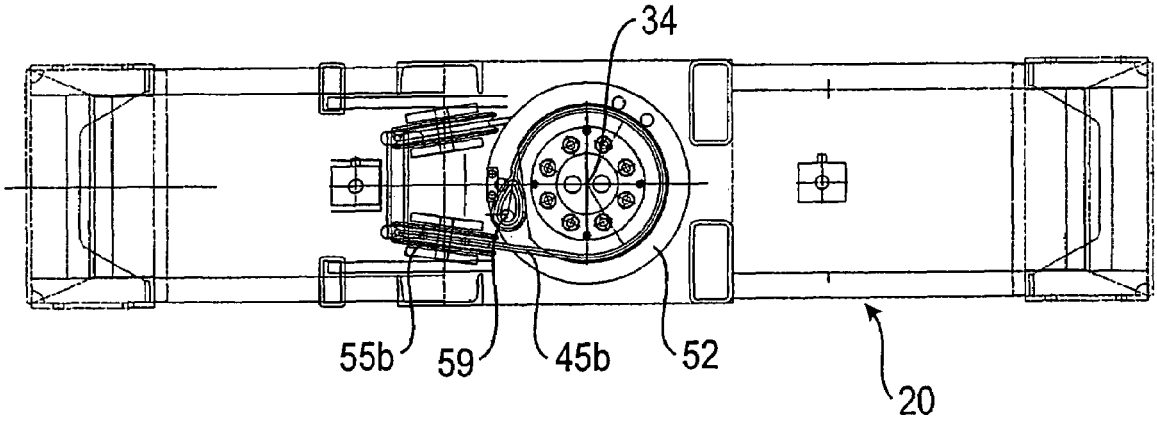
FIG. 6 shows a partially sectional view from the top of the soil stripping device of FIG. 2.

The mechanism of rotation can be taken from FIGS. 5 and 6 in particular. A first flexible element 45*a*, which is a rope with an eyelet located at its end, is deflected by the first upper deflection roller 55*a* towards the setting wheel 52. By means of the eyelet the first flexible element 45*a* is linked to a first retaining bolt 58 of the setting wheel 52 in order to bring about a relative rotation between the setting wheel 52 and the work unit 20 in the anticlockwise direction about the axis of rotation 34. With its other free end the first flexible element 45*a* is connected to the lower piston rod 47 of the linear drive 44 according to FIG. 4.

The second flexible element 45*b* is connected on the one hand through an eyelet to a second retaining bolt 59 of the setting wheel 52 and on the other hand to the upper piston rod 47 of the linear drive 44. If the upper piston rod 47 is retracted, the second flexible element 45*b* is also retracted via the second upper deflection roller 55*b*, and in doing so a relative rotation between the setting wheel 52 and the work unit 20 takes place about the axis of rotation 34. At the same time, this rotational movement causes the first flexible element 45*a* to be rewound in the clockwise direction around the setting wheel 52, whereby an anticlockwise back-rotation with the first flexible element 45*a* through approximately 180° is rendered possible again at a later stage.

The invention claimed is:

1. Soil stripping device comprising:

a base body connectable to a carrier implement, a work unit, soil working tools arranged on the work unit a bearing device supporting the work unit on the base body in a rotatable manner, a rotary device for rotating the work unit with respect to the base body about an axis of rotation, wherein the rotary device includes:

at least one linear drive for generating linear movement, wherein the linear drive has a double-acting setting cylinder having a cylinder housing having first and second sides and first and second piston rods protruding respectively from the first and second sides of the cylinder housing, wherein the double-acting setting cylinder is arranged on the work unit, and transmission means for translating linear movement generated by the linear drive into a rotating movement, wherein the transmission means includes a setting wheel, and first and second flexible elements each having first and second ends, the first end of each flexible element being linked to the setting wheel and wound around the setting wheel in opposite directions to effect rotation of the setting wheel in opposite directions when tensile forces are applied to the second flexible elements, the second ends of the first and second flexible elements being respectively attached to an end of the first and second piston rods.

2. Soil stripping device according to claim 1, wherein the transmission means is one of a rope transmission and chain transmission.

3. Soil stripping device according to claim 1, wherein the soil stripping device is a trench wall grab.

4. Soil stripping device according to claim 1, wherein the setting cylinder is a hydraulic cylinder.

5. Soil stripping device according to claim 1, wherein the setting wheel is arranged in the portion of the bearing device and coaxially with the axis of rotation.

6. Soil stripping device according to claim 1, wherein the setting wheel is arranged in a fixed manner on the base body.

7. Soil stripping device according to claim 1, wherein one flexible element is a steel rope.

8. Soil stripping device according to claim 1, wherein on the bearing device connections for hydraulic fluids are provided.

9. Soil stripping apparatus comprising:

the soil stripping device according to claim 1, a carrier implement having a mast, and a lifting device attached on the mast, the lifting device having a lower end at which the work unit of the soil stripping device is arranged.

* * * * *